US006216617B1

(12) United States Patent
Burt, Jr.

(10) Patent No.: US 6,216,617 B1
(45) Date of Patent: Apr. 17, 2001

(54) APPARATUS AND METHOD FOR EMBROIDERY HOOP MOUNTING

(76) Inventor: Robert S. Burt, Jr., 1045 Phillips Hill Rd., Columbus, MS (US) 39702

( * ) Notice: Subject to any disclaimer, the term of this patent is extended or adjusted under 35 U.S.C. 154(b) by 0 days.

(21) Appl. No.: 09/553,052

(22) Filed: Apr. 20, 2000

(51) Int. Cl.[7] ..... D06C 3/08

(52) U.S. Cl. ..... 112/103; 38/102.2

(58) Field of Search ..... 112/103; 38/102.1, 38/102.2; 33/16, 4, 11, 13, 14; 269/303, 318, 319

(56) References Cited

U.S. PATENT DOCUMENTS 4,545,127 * 10/1985 Barry ..... 33/11
4,767,111 * 8/1988 Guenther ..... 269/303
5,433,158 * 7/1995 Moore, III ..... 112/103
5,784,988 7/1998 Burt, Jr. .
5,934,210 * 8/1999 Lucchese ..... 112/103
6,067,737 * 5/2000 Guenther ..... 112/103 X
6,166,174 * 9/2000 Melton ..... 112/103

* cited by examiner

*Primary Examiner*—Ismael Izaguirre
(74) *Attorney, Agent, or Firm*—Nixon & Vanderhye

(57) ABSTRACT

A mounting system for placement of an embroidery hoop having inner and outer rings includes a flat base having orthogonally related columns and rows of apertures therethrough, mounting brackets and eccentrics. The brackets and eccentrics are mounted to the base in positions to locate and confine the hoop. The base includes index marks for aligning the article to be embroidered relative to the base and to the hoop. When the article is aligned on the base, the inner ring of the hoop is applied to engage portions of the material of the article between the outer and inner rings with the material spanning the inner ring being maintained taut. Different sized bases are provided for embroidering various sizes of different articles.

18 Claims, 5 Drawing Sheets

APPARATUS AND METHOD FOR EMBROIDERY HOOP MOUNTING

The present invention relates to apparatus and methods for embroidering which enable the embroidery hoop and the article to be embroidered to be perfectly straight relative to one another and in the correct location without excessive marking of the article or repeated rehooping.

BACKGROUND

As well known in the embroidery industry, before embroidery material is embroidered by an automated machine, the portion of the material to be embroidered must first be placed within a matched pair of rings forming an embroidery hoop. The matched pair of embroidery rings comprise inner and outer rings such that when the two rings are properly mounted on the article to be embroidered, the smaller or inner ring fits snugly inside the larger or outer ring with portions of the material of the article pinched between the rings. The hoop, comprised of the inner and outer rings, of course, can be of any closed configuration such as circular, rectangular, D-shaped or otherwise. Embroidery hoops are used to ensure that the area of the article to be embroidered is stretched tightly and evenly between the hoop rings to ensure that the embroidery is even and not distorted, as well as to facilitate handling of the article to be embroidered. Certain automated embroidery machines also require the use of hoops for proper operation.

The embroidery industry is generally segmented into commercial and household markets. In the commercial market, the hoops are mounted for use in custom die sets. The article to be embroidered is positioned over one of the rings and a mechanical press forces the rings together with the material of the article to be embroidered secured between the rings. In the household market, the rings of the embroidery hoop are mounted onto the article by hand. Particularly, the area of the material to be embroidered is positioned over the outer ring and the inner ring is then placed over the material and manually forced into the outer ring. One device particularly useful in the household market for assisting the embroiderer in this aspect is described and illustrated in U.S. Pat. No. 5,784,988.

In both the commercial and household markets, however, the embroidery must first be located on the material, for example, a garment such as a tee-shirt, sleeve or pant leg or on flat goods such as towels, sheets and the like, all hereafter individually or collectively called an article or articles. Typically, the center of the embroidery is marked on the article and additional markings are applied to the article to attempt to align the article and the hoop. If the article and hoop are not properly aligned, the resulting embroidery on the article is not straight relative to the article. For example, the embroidery may be canted or angled or positioned above, below, to the right or left of the desired position. Consequently, it is highly desirable to ensure straight hooping without excessive marking of the article or repeated rehooping to properly and correctly align the article and hoop.

DISCLOSURE OF THE INVENTION

In accordance with a preferred embodiment of the present invention, an embroidering apparatus is provided which enables the mounting of the hoop square to the article without excessive marking or rehooping. The apparatus in one preferred embodiment hereof includes a flat base having a plurality of columns and rows of apertures orthogonally related to one another, a pair of mounting brackets for positioning the hoop on the base and one or more eccentrics to loosely confine the outer ring on the base during application of the inner ring to the material and outer ring, i.e., during hooping. The brackets and eccentrics are mounted to the base by flathead mounting screws. The screws are receivable from the back of the base through apertures in the base and nuts or wingnuts are threaded onto their projecting distal ends to secure the brackets and eccentrics in place. Also, the flat base preferably has a central projection at one end for aligning an article, for example, a garment such as a tee-shirt, on the base and a flange at its opposite end turned preferably 90°. The flat base is preferably laid on a flat table with the flange end pressed between a table edge and the individual hooping the article to maintain the base stable while hooping.

To employ this first embodiment of the present invention, the location of the hoop on the base is first ascertained, generally depending on where the embroidery is to be placed on the article. With the location identified, the complete hoop is placed on the flat base and the brackets and eccentrics are disposed about the hoop in positions essentially confining the hoop with sufficient play about the hoop to enable the hoop to expand. The flathead bolts are passed through the apertures from the underside of the base and through the holes in the brackets. The nuts or wingnuts are threaded onto the bolts to maintain the brackets in place. The eccentrics are similarly secured to the base using offset mounting holes so that the eccentrics can be rotated into a final position and secured by the bolt and nut arrangements. With the hoop located, the inner ring is removed and a stabilizer is temporarily secured, e.g., by tape, to the brackets overlying the outer ring. With the center of the article ascertained, the article is placed over the base and outer ring. The article is aligned to the base using an index guide which may comprise the orthogonally related rows of apertures, grid lines applied to the base, or a groove formed along the middle of the base, squaring the article relative to the outer ring of the hoop previously placed on the base. By aligning the article relative to the base, the area to be embroidered is square to the outer hoop ring on the base and to the article. The inner ring of the hoop is then applied to the outer ring, securing portions of the material of the article and the stabilizer between the hoop rings, rendering the material spanning the inside of the rings taut. The hoop and article are then removed from the base and the material is embroidered, with the assurance that the embroidery is straight to the article.

In a further embodiment of the present invention, a kit is provided comprised of a plurality of similar flat bases having angled flanges at one end. In this form, the bases may be mounted on an inclined surface of a stand with the angled flange engaged against a table edge or an edge of the stand to maintain the base in a stable position on the stand. The base is provided in several sizes. For example, a large sized-base with orthogonally related columns and rows of apertures, a central projection at one end and a flange at an angle of about 120°, is provided for use with large-size articles such as adult tee-shirts. An intermediate sized base of similar construction but of reduced width relative to the large base is provided with a reduced number of columns of apertures. The intermediate sized base is used, for example, for embroidering children-sized tee-shirts. Similarly, a small flat base of reduced width relative to the intermediate sized base is provided with a reduced number of columns of apertures for locating embroidery on articles such as sleeves, pant legs and the like. Each of the bases of the kit of this second embodiment is employed similarly as previously described with respect to the base of the first embodiment. Preferably, however, these bases are used with an inclined stand. Also, pins are preferably employed for placement through the brackets and eccentrics from the outer surface of the base. This avoids any need to insert screws from the backsides of the bases.

In this further form, one of the bases is selected depending upon the nature and size of the article to be embroidered, and the selected base is secured to the stand. The location of the article on the hoop proceeds similarly as in the first mentioned embodiment with the exception that the mounting brackets and eccentrics are secured to the selected base by removable pins inserted through the brackets and eccentrics from the front working surface of the selected base.

In a preferred embodiment according to the present invention, there is provided a mounting system for placement of a hoop having inner and outer rings for embroidering an article, comprising a flat base having a plurality of spaced apertures arranged in orthogonally related rows and columns, a pair of mounting brackets each having a linear surface, mounting pins for securing each bracket to the base in a selected position with the linear surface of each bracket extending generally parallel to one of the columns or rows of apertures and positioned to locate both inner and outer rings of an embroidery hoop on the base and at least one eccentric having an off-center mounting pin engageable in one of the apertures to mount the eccentric on the base and enable rotation thereof into a position to substantially confine the hoop between the mounting brackets and the eccentric.

In a further preferred embodiment according to the present invention, there is provided a kit for mounting a hoop having inner and outer rings for embroidering articles of different types and sizes, comprising a flat first base having a plurality of spaced apertures arranged in orthogonally related rows and columns and having a first predetermined width for embroidering articles of a large size, a second flat base having a plurality of spaced apertures arranged in orthogonally related rows and columns having a width less than the predetermined width of the base enabling embroidering articles of an intermediate size, a third flat base having a plurality of spaced apertures arranged in orthogonally related rows and columns having a predetermined width less than the predetermined width of the second base enabling embroidering articles of a small size, a pair of mounting brackets each having a guide surface, mounting pins for securing each of the brackets to a selected one of the bases in a position with the guide surfaces of the brackets arranged to at least in part confine an embroidery hoop on one base and at least one eccentric having an off-center mounting pin engageable in one of the apertures of one base to mount the eccentric to one base and enable rotation thereof into a position to substantially confine the hoop between the mounting brackets and the eccentric mounted to the base.

In a still further preferred embodiment according to the present invention, there is provided a method of squaring an inner ring of an embroidery hoop to a flat base and aligning an article to be embroidered relative to the base, comprising the steps of mounting a pair of brackets each having a linear surface to and in selected locations along the base to at least partially define the location of an outer ring of the embroidery hoop along the base, mounting a pair of eccentrics to and at selected locations along the base and rotating the eccentrics to positions further defining the location of the outer ring along the base, disposing a surface of the article to be embroidered along the base overlying the outer ring of the embroidery hoop, aligning the article to be embroidered relative to the base by aligning selected portions of the article with at least one guide carried by the base and engaging an inner ring of the embroidery hoop along the article and along an interior margin of the outer ring to locate portions of the article between the rings thereby tensioning portions of the article spanning the inner ring.

BEST MODE FOR CARRYING OUT THE INVENTION

Figure 1:
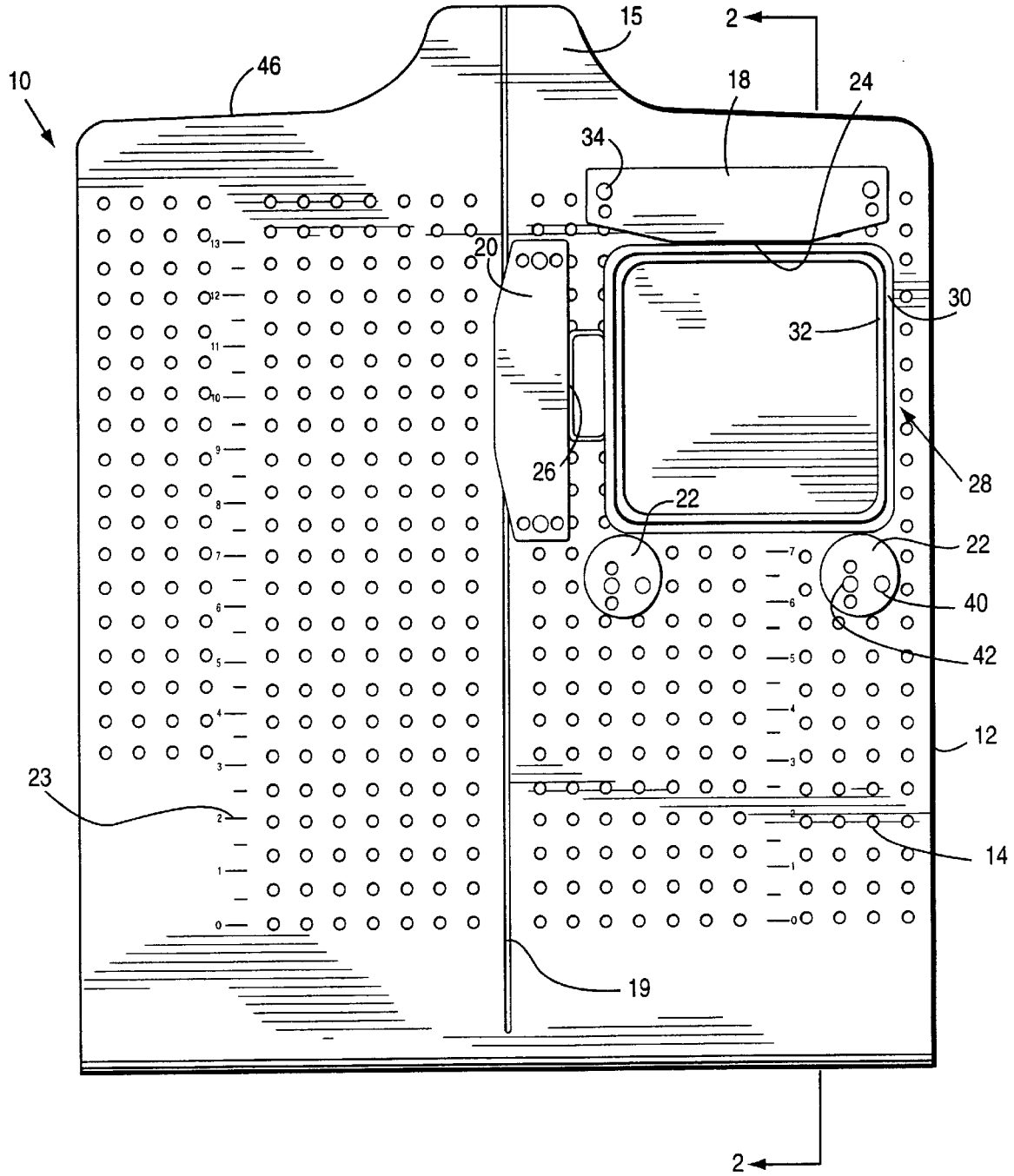
FIG. 1 is a plan view of an apparatus for centering an article to be embroidered and an embroidery hoop relative to one another according to a first embodiment of the present invention.
Figure 2:
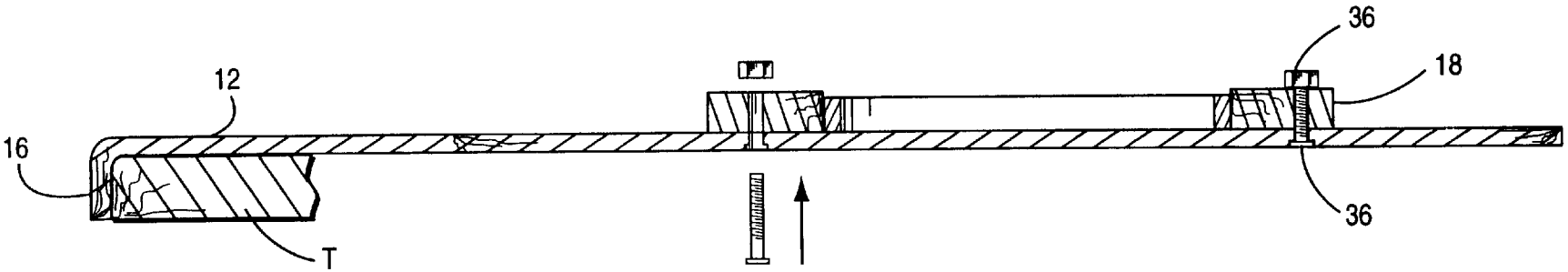
FIG. 2 is a cross-sectional view thereof taken about on line 2—2 in FIG. 1.

Referring now to the drawing figures, particularly to a first embodiment of the present invention illustrated in FIGS. 1 and 2, there is illustrated an embroidery apparatus, generally designated 10, including a flat base 12 having a plurality of apertures 14 preferably arranged in orthogonally related columns and rows thereof. The base 12 may be formed of any suitable material, for example, pressed particleboard. As best illustrated in FIG. 1, one edge of the base 12 has a central projection 15 used for centering a garment on the base. As illustrated in FIG. 2, an opposite edge of base 12 has a flange 16 projecting from the flat base 12 at right angles thereto for stabilizing the base as explained hereafter. A central groove 19 extends along the front or working surface of the base 12 parallel to the columns of apertures 14 and grid lines 23 are also applied, forming gradations. The central groove 19, the grid lines 23 or the columns and rows of apertures 14 form guides for aligning the article on the base 12.

The apparatus also includes a pair of mounting brackets 18 and 20, as well as one or more and preferably a pair of eccentrics 22. The mounting brackets 18 and 20 have respective guide surfaces 24 and 26, preferably linear, for engaging a corresponding linear surface of the outer ring of a hoop, generally designated 28. The surfaces 24 and 26, however, need not be linear. As illustrated in FIG. 1, hoop 28 includes an outer ring 30 and an inner ring 32, it being appreciated that the rings can be circular, rectilinear, D-shaped or otherwise. The outer and inner rings are sized such that the inner ring 32 fits snugly within the outer ring 30 with portions of the material of the article to be embroidered therebetween whereby the material spanning the hoop can be tightly and evenly stretched, i.e., held taut. The mounting brackets 18 and 20 also have a plurality of holes 34 therethrough whereby the location of the brackets along the base 12 can be adjusted as necessary to confine the outer ring 30 within the brackets.

In this embodiment of the invention, flathead bolts 36 (FIG. 2) are disposed through the apertures 14 from the underside or backside of the base 12 for reception in the holes 34 of the brackets 18 and 20. The apertures 14 are preferably countersunk on the backside of the base such that the bolt heads lie flush with or are recessed within the underside of the base 12. The distal ends of the bolts project through the holes 34 and nuts or wingnuts 36 may be threaded on the bolt ends to secure the brackets to the base 12. As illustrated in FIG. 1, the eccentrics 22 have an offset opening 40. With a bolt passing through the offset opening 40, it will be appreciated that the eccentrics 22 can be pivoted about the bolts into positions lying closer to or further away from the margin of the hoop 28. Additional openings 42 are provided in each eccentric and similar nut-and-bolt arrangements are used to secure the eccentrics in appropriate rotary position relative to the hoop to substantially locate the hoop 28 on the base 12.

To employ the apparatus illustrated in FIGS. 1 and 2 to ensure straight hooping without excessive marking and repeated rehooping of the article, the hoop 28 is first located on the flat base 12 depending on the location of the desired embroidery on the article. In the illustrated example, the hoop 28 is located in the right upper corner of the base 12 for a left front breast placement of the embroidery. The complete hoop 28, including the outer and inner rings 30 and 32, respectively, is placed on the base 12 at the proper location, i.e., the upper left corner of base 12, and the brackets 18 and 20 are secured to the base 12. The brackets may be mounted by lifting the base from a work surface, e.g., a table T (FIG. 2) and pushing the flathead bolts 36 through selected apertures 14 corresponding holes 34 in the bracket. While holding the bolt in place, a nut or wingnut 38 is applied to the end of each bolt projecting from the upper faces of the brackets. Preferably, the two brackets 18 and 20 are placed on the base at right angles to one another, although other positions such as 45° angles can be used. The eccentrics can then be mounted by similarly inserting bolts from the backside of base 12 through the aligned apertures 14 and holes 40. Once each eccentric is secured by a single bolt, the eccentrics are rotated into appropriate position and secured in that position similarly by inserting bolts from the backside of the base and threading nuts on the projecting ends of the bolts. Sufficient room should be allowed between the brackets, including the eccentrics, and the hoop to enable the hoop to expand and thus the brackets and eccentrics only loosely confine the hoop. The inner ring 32 of hoop 28 is then removed.

The center point of the embroidery on the article is then ascertained. For example, if the article comprises a tee-shirt, the garment may be folded vertically with the shoulder seam and centerline of the garment at the fold serving as base points for measuring to the center of the intended embroidery. For the illustrated left breast placement, a measurement six to eight inches down from the shoulder seam and four to six inches over from the front centerline can be used to locate the center of the embroidery for left breast placement.

With the center of the embroidery located and marked on the tee-shirt, and the outer ring of the hoop within the brackets and eccentrics, a stabilizer is first disposed over the brackets, eccentrics and outer ring 30 and is taped to the brackets. The garment is then pulled over the base 12 with the working surface of the garment on the front. With the shoulder seams of the garment aligned with the upper shoulder edges 46 of base 12, the collar of the tee-shirt centered about the projection 15, and the center of the garment aligned with the center groove 19 along the base, the garment is straight to the base 12 and to the hoop 28. The garment centerline and groove 19 are aligned by feeling through the garment to the groove. With the base 12 placed on a table and the flange 16 of the base pressed against the table edge to stabilize the base 12 as illustrated in FIG. 2, the inner ring 32 of the hoop 28 can be applied to the outer ring 30 to snugly secure the garment and stabilizer between the inner and outer rings, for example, by using the apparatus set forth in prior U.S. Pat. No. 5,784,988.

It will be appreciated that the apparatus of FIGS. 1 and 2 can similarly be employed to embroider flat goods. To accomplish this, the center of the material to be embroidered is marked. With the hoop and brackets located as previously described, and the stabilizer applied, the gridlines on the base, as well as the columns and rows of apertures, or the groove 19 may serve as index guides to square the flat goods relative to the base and hence to the hoop.

Figure 5:
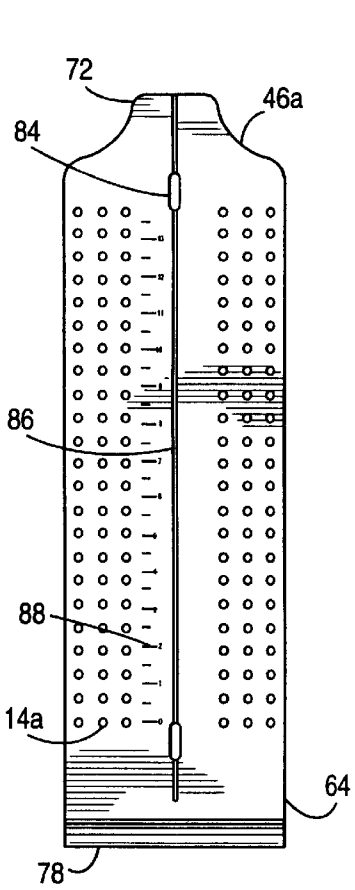
FIGS. 3, 4 and 5 are views similar to FIG. 1 illustrating a plurality of different sizes of bases similar to the base of FIG. 1 for use in a second embodiment of the present invention.
Figure 4:
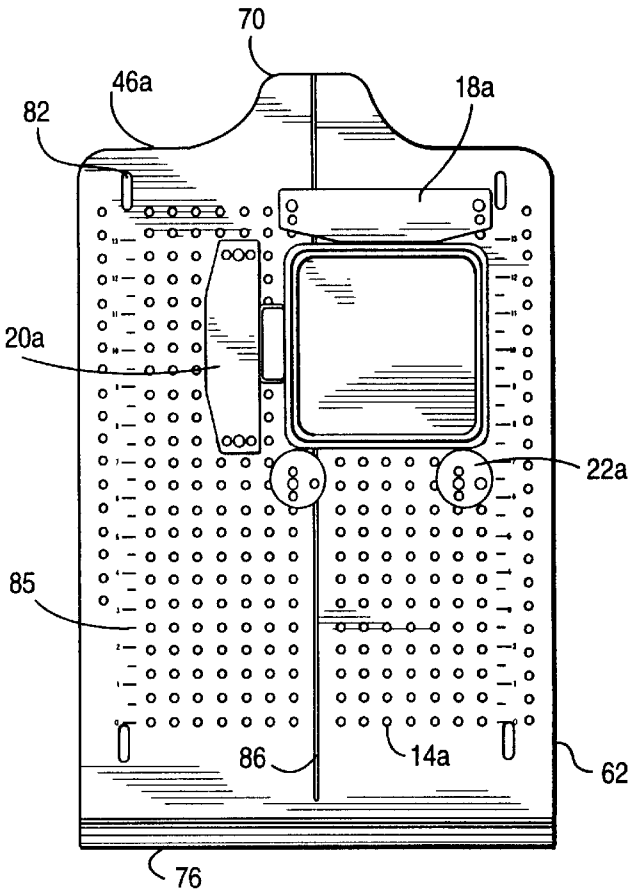
Figure 3:
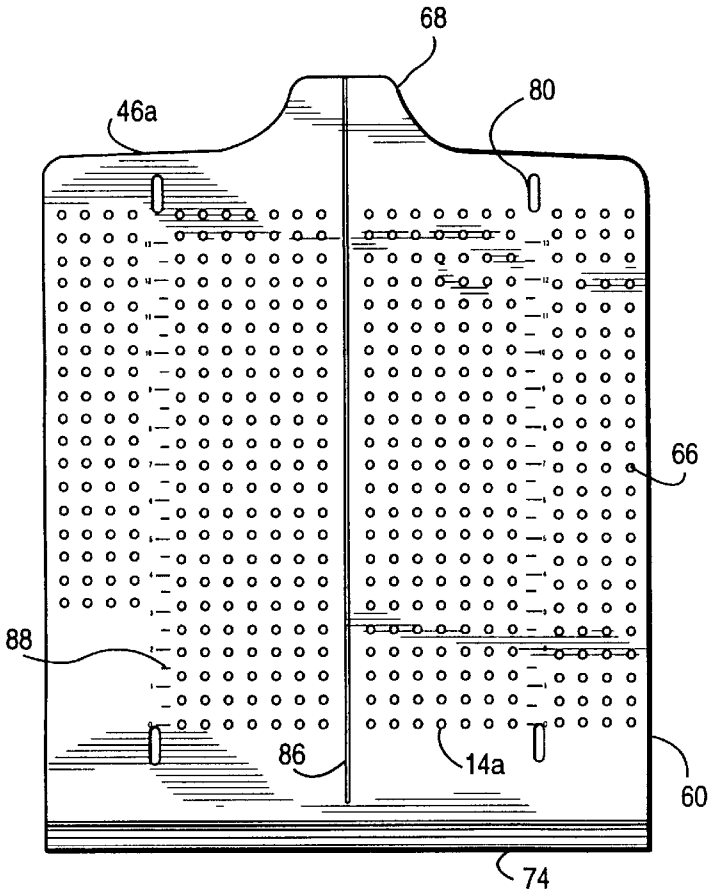
Figure 6:
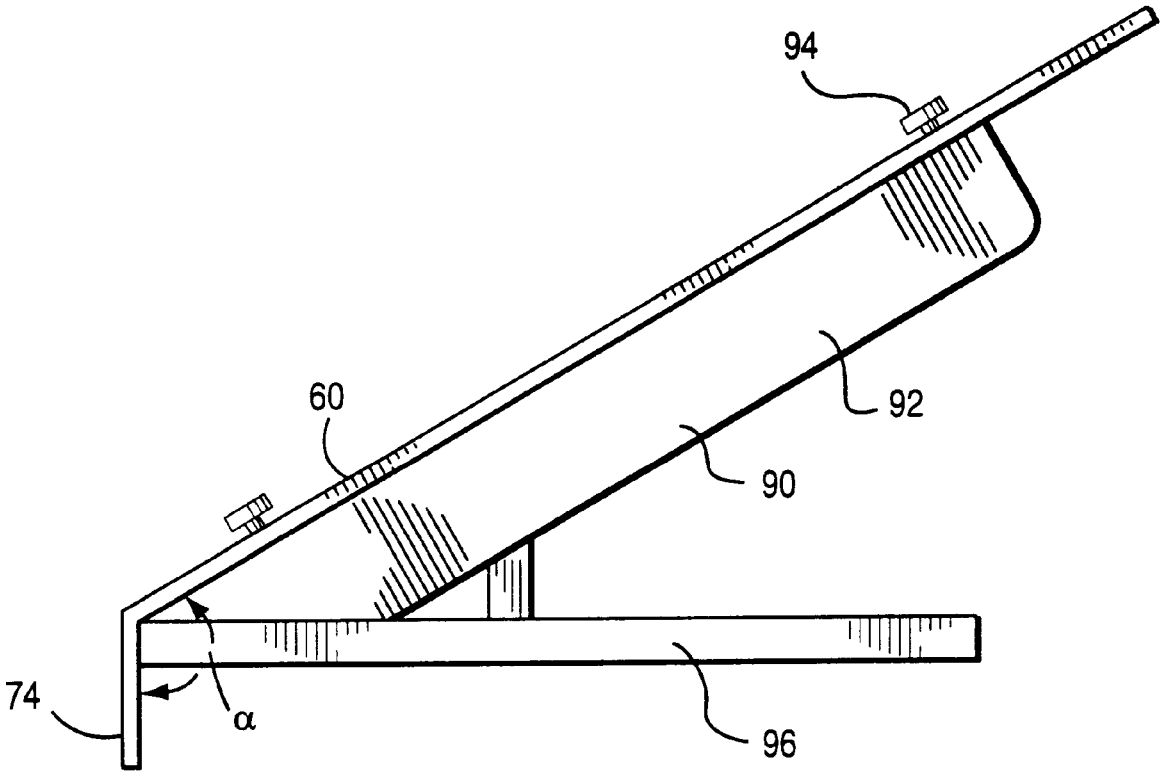
FIG. 6 is a side elevational view illustrating a stand and one of the bases illustrated in FIG. 3 in position for squaring the article relative to the hoop.

Referring now to FIGS. 3–8, a hooping kit is provided. In FIGS. 3, 4 and 5, bases similar to the base 12 of FIG. 1 are provided in different sizes. For example, a flat base 60 is provided in a large size of a predetermined width. An intermediate sized base 62 is provided with a reduced width. Finally, a small base 64 is provided with a width reduced from that of both bases 60 and 62. In each base 60, 62 and 64, rows and columns of orthogonally related apertures 66 are provided. As in the previous embodiment, each of the bases 60, 62 and 64 includes a central projection 68, 70 and 72 along one edge thereof. Along the opposite edge, a flange 74, 76 and 78 is formed which extends at an angle $\alpha$ in excess of 90°, preferably about 120°, as illustrated in FIG. 6. Also in this embodiment, a plurality of mounting slots 80 and 82 are provided each of the bases 60 and 62 adjacent the upper and lower corners thereof, whereas a pair of mounting slots 84 are provided along a centerline of the base 64. Each base also includes a central groove 86 and grid lines 88 as in the prior embodiment.

The bases 60, 62 and 64 are provided as part of a kit which also includes the mounting brackets 18*a* and 20*a*, as well as the eccentrics 22*a* similar to the prior embodiment. Thus, depending upon the article to be embroidered, one or another of the bases of the kit is utilized in conjunction with the mounting brackets and eccentrics. As part of the kit and as illustrated in FIG. 6, a stand 90 is provided. The selected base 60, 62 or 64 is preferably secured to the inclined brackets 92 of the stand 90 by threaded bolts 94 received through the openings 80, 82 or 84. The stand 90 includes a flat base frame 96 for lying on a table with the flanges 74, 76 or 78 of the selected base disposed along an edge of the frame 96. Also, instead of flatheaded bolts and thumbscrews or nuts as used in the embodiment of FIGS. 1 and 2, pins 98 engageable through the brackets and eccentrics from the front side of the selected base and into the apertures 14*a* are employed to releasably secure the brackets and eccentrics to the selected base on the stand 90. The pins 98 have springbiased, laterally projecting balls on their distal ends to releasably retain the pins in place on the selected base.

Figure 7:
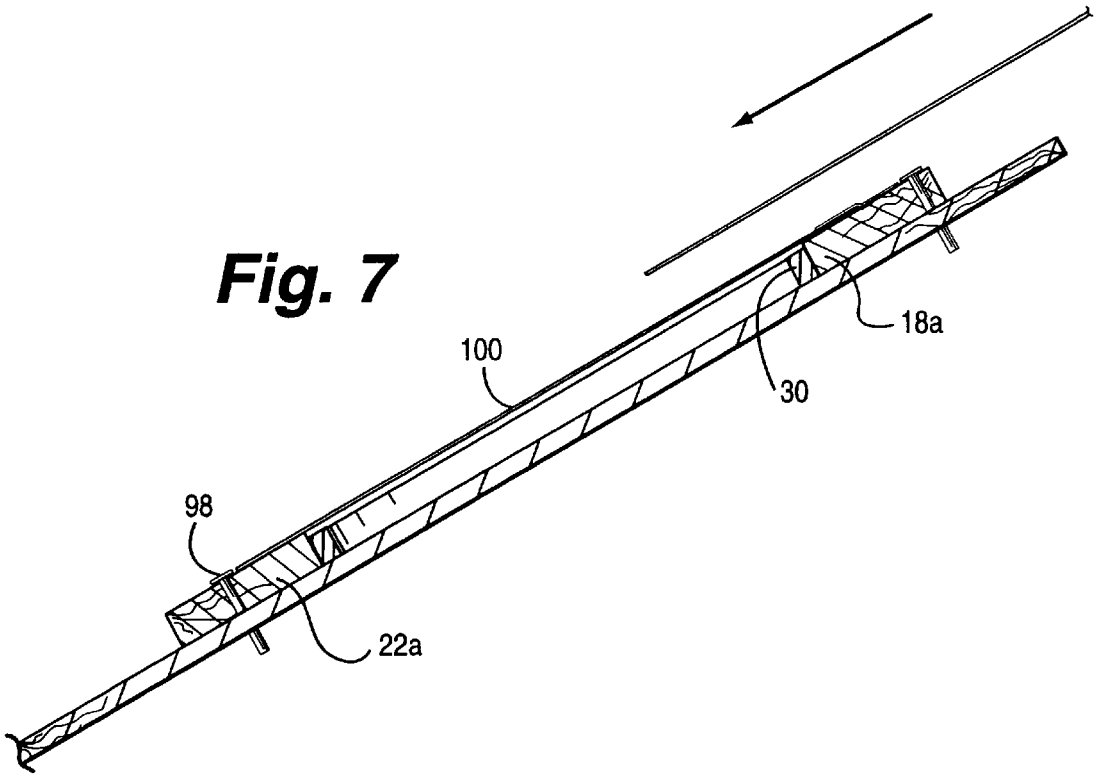
FIGS. 7 and 8 are schematic cross-sectional views illustrating the manner of placement of the article and the hoop rings on the selected base.
Figure 8:
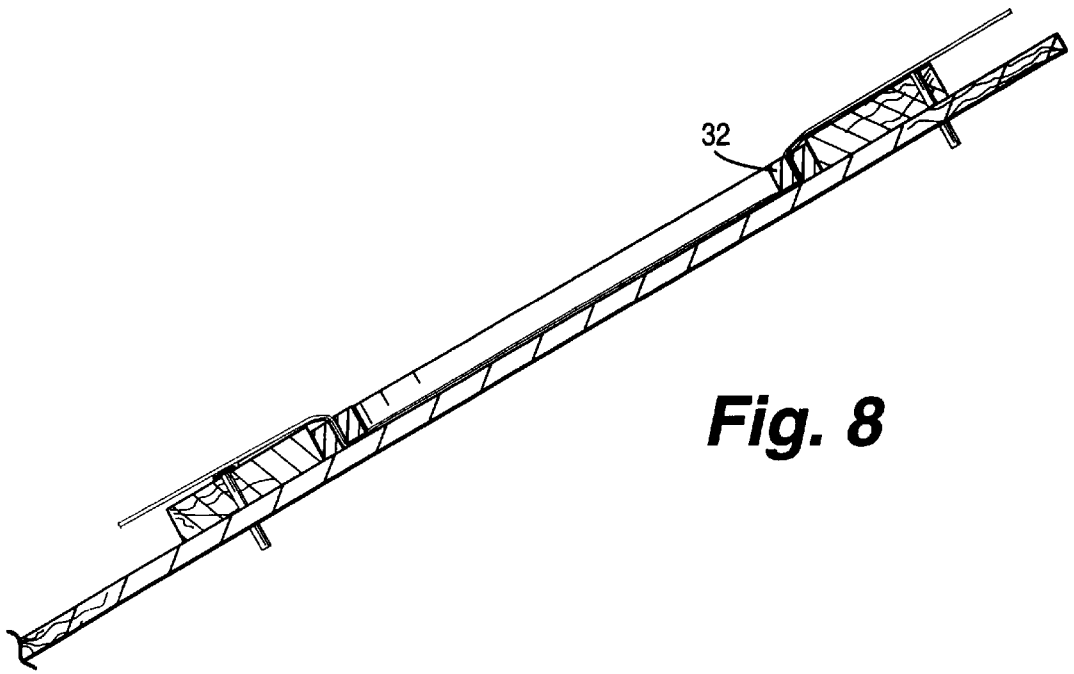

In use, with the selected base 60, 62 or 64 disposed on the inclined surface of the stand 90, the brackets and eccentrics are located along the selected base as previously described and pinned in place. For example, the pins 98 may be received through the aligned openings of the brackets and apertures from the upper side of the base. The brackets and eccentrics are thus secured to the selected base to confine the hoop on the base. As illustrated in FIG. 7, and after the center of the article has been located as previously described, a stabilizer 100 is taped to the brackets in overlying relation to the outer ring 30 of the hoop 28. The article is then placed over the selected base as well as the inclined portions 92 of the stand with one or more of the upper edges 46*a* of the base, the columns or rows of apertures, the central groove or the grid lines 88 providing guides for aligning the article relative to the selected base with the center of the embroidery located within the outer ring 30 of the hoop 28. The inner ring 32 of the hoop is then inserted within the outer ring 30, snugly securing the stabilizer and portions of the article between the two rings and rendering the material spanning the inner ring 32 taut. The hoop 28 and article can then be removed from the selected base and the embroidering may proceed.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A mounting system for placement of a hoop having inner and outer rings for embroidering an article, comprising:

a flat base having a plurality of spaced apertures arranged in orthogonally related rows and columns;

a pair of mounting brackets each having a linear surface;

mounting pins for securing each bracket to said base in a selected position with the linear surface of each bracket extending generally parallel to one of said columns or rows of apertures and positioned to locate both inner and outer rings of an embroidery hoop on said base; and at least one eccentric having an off-center mounting pin engageable in one of said apertures to mount the eccentric on the base and enable rotation thereof into a position to substantially confine the hoop between the mounting brackets and the eccentric.

2. A system according to claim 1 wherein said base has index marks defining a guide for centering the article on the base.

3. A system according to claim 2 wherein said index marks include a groove formed along a face of the base and extending parallel to the columns of the apertures.

4. A system according to claim 1 wherein said flat base has a flange extending at an angle to a plane containing said flat base, said angle being in excess of 90°.

5. A system according to claim 1 wherein said base includes a projection at one end of the base for receiving and centering an article on the base.

6. A system according to claim 2 wherein said index marks include a groove formed along a face of the base and extending parallel to the columns of apertures, said flat base having a flange extending at an angle in excess of 90° to a plane containing said flat base, said base including a projection at one end of the base for receiving and centering an article on the base, said projection being centered along said groove.

7. A system according to claim 1 wherein said base has a predetermined width, a second base having a width less than said predetermined width, said second base having a plurality of spaced apertures arranged in orthogonally related rows and columns, said mounting brackets and said one eccentric being mountable to one of the first mentioned base and said second base.

8. A system according to claim 7 wherein each of said first and second bases includes a groove extending parallel to a column of apertures thereof defining a guide for establishing the center of an article to be embroidered, each of said bases having a flange extending at an angle in excess of 90° to a plane containing the flat base thereof, said first and second bases including a projection at one end thereof for receiving and centering an article on the respective bases.

9. A system according to claim 7 including a third base having a width less than the width of said second base, said third base having a plurality of spaced apertures arranged in orthogonally related rows and columns, said mounting brackets and said one eccentric being mountable on one of said first, second and third bases.

10. A system according to claim 9 wherein each of said first, second and third bases includes a groove extending parallel to a column of apertures therealong defining a guide for establishing the center of articles to be embroidered employing said bases, each said base having a flange extending at an angle in excess of 90° to a plane containing the flat base thereof, each said first, second and third bases including a projection at one end for receiving and centering an article to be embroidered on the bases.

11. A system according to claim 1 including a second eccentric having an off-center mounting pin engageable in one of said apertures to mount the second eccentric to said base and enable rotation thereof into a position to substantially confine the hoop between the mounting brackets and the eccentrics.

12. A system according to claim 11 wherein one of said mounting brackets is adjustable relative to said base and the mounting pins securing said one mounting bracket to said base.

13. A kit for mounting a hoop having inner and outer rings for embroidering articles of different types and sizes, comprising:

a flat first base having a plurality of spaced apertures arranged in orthogonally related rows and columns and having a first predetermined width for embroidering articles of a large size;

a second flat base having a plurality of spaced apertures arranged in orthogonally related rows and columns having a width less than said predetermined width of said base enabling embroidering articles of an intermediate size;

a third flat base having a plurality of spaced apertures arranged in orthogonally related rows and columns having a predetermined width less than the predetermined width of said second base enabling embroidering articles of a small size;

a pair of mounting brackets each having a guide surface;

mounting pins for securing each of the brackets to a selected one of said bases in a position with the guide surfaces of said brackets arranged to at least in part confine an embroidery hoop on said one base; and at least one eccentric having an off-center mounting pin engageable in one of said apertures of said one base to mount the eccentric to said one base and enable rotation thereof into a position to substantially confine the hoop between the mounting brackets and the eccentric mounted to said base.

14. A system according to claim 13 wherein each said base has index marks defining guides for establishing the center of the article to be embroidered using the base.

15. A system according to claim 13 wherein each said base has a flange extending at an angle to a plane containing said base, said angle being in excess of 90°.

16. A system according to claim 13 wherein each said base includes a projection at one end thereof for receiving and centering an article on said base.

17. A system according to claim 13 wherein said guide surfaces on said mounting brackets comprise linear extending surfaces.

18. A method of squaring an inner ring of an embroidery hoop to a flat base and aligning an article to be embroidered relative to the base, comprising the steps of:

mounting a pair of brackets each having a linear surface to and in selected locations along the base to at least partially define the location of an outer ring of the embroidery hoop along the base;

mounting a pair of eccentrics to and at selected locations along the base and rotating the eccentrics to positions further defining the location of the outer ring along the base;

disposing a surface of the article to be embroidered along the base overlying the outer ring of the embroidery hoop;

aligning the article to be embroidered relative to the base by aligning selected portions of the article with at least one guide carried by said base; and engaging an inner ring of the embroidery hoop along the article and along an interior margin of the outer ring to locate portions of the article between the rings thereby tensioning portions of the article spanning the inner ring.

* * * * *